United States Patent [19]

Aida et al.

[11] 4,260,665

[45] Apr. 7, 1981

[54] ELECTRON TUBE CATHODE AND METHOD FOR PRODUCING THE SAME

[75] Inventors: Toshiyuki Aida; Sadanori Taguchi, both of Tokyo; Isamu Yuito, Ome; Ushio Kawabe, Hamuramachi; Shigehiko Yamamoto, Tokorozawa; Yukio Honda, Fuchu; Norio Shibata, Honmacki; Hiroshi Okano, Tokyo, all of Japan

[73] Assignee: Hitachi, Ltd., Tokyo, Japan

[21] Appl. No.: 946,194

[22] Filed: Sep. 27, 1978

[30] Foreign Application Priority Data

Sep. 30, 1977 [JP] Japan ..... 52-116842

[51] Int. Cl.[3] ..... H01J 1/14

[52] U.S. Cl. ..... 428/633; 75/246; 313/346 R; 428/548; 428/670; 428/680

[58] Field of Search ..... 313/346 R, 345; 428/632, 633, 670, 680, 548; 75/246, 248; 148/31.5

[56] References Cited

U.S. PATENT DOCUMENTS

| | | | |
|---|---|---|---|
| 3,166,836 | 1/1965 | Bigler | 75/246 |
| 3,240,569 | 3/1966 | Buescher | 313/346 R |
| 3,558,966 | 1/1971 | Hill | 313/345 |
| 4,129,801 | 12/1978 | Soeno et al. | 313/346 R |

*Primary Examiner*—Michael L. Lewis

*Attorney, Agent, or Firm*—Craig and Antonelli

[57] ABSTRACT

An electron tube cathode in such a structure comprising a Ni-W-Zr alloy (W content: 20–28 wt. %) having a grain size of 4–10 μm as a base metal, a 1,000–2,000 Å-thick Pt film provided on the surface of the base metal, and an electron emitting material layer consisting of alkaline earth metal oxide provided on the Pt film has less emission lowering and less peeling of the electron emitting material layer, even if placed in a long time service. The electron tube cathode can be produced according to a method comprising (i) a step of annealing a base metal of Ni-W-Zr alloy (W content: 20–28 wt. %) at 1,000°–1,200° C., (ii) a step of providing a 1,000–2,000 Å thick Pt film on the surface of the base metal, and (iii) a step of providing an electron emitting material layer consisting of alkaline earth metal oxide on the Pt film.

11 Claims, 15 Drawing Figures

VIIB–VIIB SECTION

VIIB–VIIB SECTION

ELECTRON TUBE CATHODE AND METHOD FOR PRODUCING THE SAME

BACKGROUND OF THE INVENTION

1. Field of the Invention

This invention relates to an electron tube cathode used in television tube, etc., particularly to an electron tube cathode having a short rise time for reaching an actuation state, and more particularly to an electron tube cathode having a base metal consisting of a nickel-based alloy containing tungsten in solid solution approximately up to its solubility limit (20–28% by weight of tungsten) to enhance a high temperature strength, and furthermore to a method for producing these electron tube cathodes.

2. Brief Description of the Prior Art

Television tubes now used are mostly of an indirectly heated tube, using a base metal consisting of a Ni-0.05% Mg alloy or a Ni-(2–4)% W alloy, each alloy further containing a reducing impurity. This type of heating utilizes a heated radiation of a tungsten filament inserted in a cathode sleeve. Thus, in the conventional television tube, it takes about 30 seconds to make a normal picture on screen. To improve this disadvantage, the tungsten filament in the indirectly heated type cathode is made finer, and furthermore to improve a radiation efficiency, a tungsten heater surface is subjected to a black treatment. As a result, the rise time can be made as short as about 5 seconds. However, in order to produce an instantaneous picture of much shorter duration, it is necessary to decrease a heat capacity. That is, the thickness of base metal must be greatly reduced from the presently prevailing size of 100–150 μm. However, the reduction of the thickness of base metal has the following problems in the conventional cathode metal composition:

(i) Content of reducing impurity is decreased, and consequently an emission life is shortened.

(ii) High temperature strength is lowered, and thus a heat stress generated by reaction between oxides constituting an electron-emitting material and the base metal cannot be cancelled, causing a heat deformation to lose a white balance between R.G.B guns.

A high temperature strength can be obtained by adding tungsten to nickel approximately up to its solubility limit. Even in a directly heated type cathode, in which the cathode metal is heated by direct passage of electric current, a high temperature strength and a high specific resistance are required. To this end, tungsten is usually added to nickel approximately up to its solubility limit.

The cathode metal of such a composition has distinguished mechanical and electrical properties, but is not practically utilized owing to an unstableness of its emission characteristics. That is, a tungsten interface layer (a reaction product from tungsten oxide and alkaline earth metal oxide, formed at a boundary between the base metal and the alkaline earth metal oxide coating) is extremely increased in a cathode metal having a tungsten content as large as 20–28% by weight, while the tungsten interface layer is not a serious problem in the ordinary cathode metal having a small tungsten content, for example, 2–4% by weight. Such an extreme increase in the tungsten interface layer consequently causes to peel the oxide coating off, and further causes to deteriorate or fluctuate emission characteristics, making the cathode metal unreliable.

In the case of directly heated type, the base metal must be as thin as 30–40 μm, and thus the content of the reducing impurity must be about 5 times as large as that of the indirectly heated type having 150 μm thickness. For example, when zirconium, which is well-known for a high diffusion speed as the reducing impurity, is added to a cathode metal, the necessary amount of zirconium to be added is 0.3–0.5% by weight, and Ni-28 wt% W-0.4 wt% Zr can be given as one example of alloy composition for the directly heated type cathode metal.

However, the Ni-based alloy for the cathode metal so far practically employed contains 2–3% by weight of tungsten, and it has been said that it is impossible to use a Ni-based alloy containing 20–28% by weight of tungsten as the cathode metal on account of the peeling of the oxide coating and deterioration of emission characteristics.

The following references are cited to show the state of the art; (i) U.S. Pat. No. 2,833,647, (ii) U.S. Pat. No. 3,374,385, and (iii) Japanese Patent Publication No. 6,918/61.

SUMMARY OF THE INVENTION

An object of the present invention is to overcome said drawbacks of the prior arts in an electron tube cathode having a cathode metal consisting of Ni-based alloy containing tungsten in solid solution approximately to its solubility limit composition, by greatly improving its emission characteristics and preventing the oxide coating from peeling, thereby enhancing a reliability of the cathode.

To attain said object, the present invention provides an electron tube cathode, which comprises a base metal consisting of nickel alloy containing 20–28% by weight of tungsten and a very small amount of a reducing impurity, a film consisting of platinum or rhenium provided on the base metal, and an electron emitting material layer consisting of alkaline earth metal oxide provided on the film.

If the tungsten content of the base metal is less than 20% by weight, the high temperature strength and specific resistance of the base metal are lowered, and are unsatisfactory and unpreferable particularly for the electron tube cathode of directly heated type. If the tungsten content of the base metal exceeds 28% by weight on the other hand, an intermetallic compound is formed, unpreferably impairing the evenness of the characteristics. More preferable tungsten content is 25–28% by weight.

As the reducing impurity, zirconium or hafnium can be used, and a good result can be obtained, for example, with about 0.4% by weight of zirconium or hafnium in the case of directly heated type cathode, but the amount to be added is not restricted thereto. That is, the amount of zirconium or hafnium can be within a concentration range employed in the ordinary cathode containing zirconium or hafnium as the reducing impurity. Zirconium and hafnium can be added together.

Grain size of Ni-based alloy constituting the cathode metal is not more than 1 μm when the ordinary rollers are employed, and a considerable effect can be expected in the present invention even with such a grain size, but if the grain size is larger, the interface layer is less formed between the base metal and the electron emitting material layer, and a good result can be obtained. Particularly when a base metal having grain sizes of 4–10 μm is used, a considerably better electron tube cathode can be obtained than when a base metal having smaller grain sizes is used. If the grain size is less than 4 μm, an effect of coarseness of grain size is not satisfactory, whereas, if the grain size exceeds 10 μm, the base metal is unpreferably liable to undergo grain rupture.

Thickness of the film consisting of platinum or rhenium must be 1,000–2,000 Å. If the thickness is below 1,000 Å, an effect of providing the film is not satisfactory. On the other hand, if the thickness is above 2,000 Å, no considerable increase in the effect is observed, showing a tendency of saturation. At the same time, a cost is inevitably increased with increasing thickness of the film. When the thickness of the film is small, formation of the interface layer can be advantageously prevented by the presence of the film when electron tubes are produced, and also a stable electron emission can be advantageously obtained when the cathode is actuated, because most of platinum or rhenium has been already dissolved into the base metal and thus diffusion of the reducing impurity is not prevented by the film. If the platinum film or rhenium film is thicker, platinum or rhenium cannot be easily dissolved into the base metal, and thus said advantages cannot be expected. The film-constituting element is platinum or rhenium, as described above, but rhenium is considerably expensive and somewhat inferior in oxidation resistance to platinum. Thus, platinum is preferable to rhenium.

The alkaline earth metal oxide used for the electron emitting material layer is usually a mixture of barium oxide, strontium oxide, and calcium oxide, whose atomic ratio of Ba:Sr:Ca is generally 0.5:0.4:0.1 but the present invention is not restricted to said mixture. Any of the alkaline earth metal oxides can be used in the present invention, so long as it is an electron emitting material of alkaline earth metal oxide system. Its thickness is also well-known in the relevant field, and any thickness within the range so far usually employed can be also employed in the present invention.

To prevent the electron emitting material layer from peeling, a cathode comprising nickel powders or nickel-tungsten alloy powders deposited on a base metal, and further an electron emitting material layer deposited thereon is known, and the present invention is also applicable to such a cathode. That is, an electron tube cathode having such a structure that a film of platinum or rhenium is provided on said base metal, and nickel powders or nickel-tungsten alloy powders are deposited on the film, or nickel powders or nickel-tungsten alloy powders are deposited on the base metal, and a film of platinum or rhenium is further provided thereon, and an electron emitting material layer is provided on the nickel powders or nickel-tungsten powders, or the film of platinum or rhenium, can also satisfactorily attain the object of the present invention. Tungsten content of the nickel-tungsten alloy powders must be usually substantially equal to the tungsten content of base metal. Deposition of nickel powders or nickel-tungsten powders onto the surface of base metal can serve against the sparks of oxide, a problem encountered when a large current emission is obtained from a cathode, and also can provide one of possibilities for a high current density cathode.

The present electron tube cathode can be readily produced according to a method comprising (i) a step of providing a film of platinum or rhenium on a base metal consisting of nickel-based alloy containing 20–28% by weight of tungsten and a very small amount of a reducing impurity, and (ii) a step of providing an electron emitting material layer consisting of alkaline earth metal oxide on the film. The electron tube cathode provided with nickel powders or nickel-tungsten alloy powders between the base metal and the electron emitting material layer can be readily produced according to a method comprising conducting a step of depositing nickel powders or nickel-tungsten alloy powders before step (i), or between step (i) and step (ii) of said former method. The step of depositing nickel powders or nickel-tungsten alloy powders is well-known in the field of electron tube cathode production.

Furthermore, in order to make the grain size of the base metal 4–10 μm, nickel-based alloy annealed at 1,000°–1,200° C. must be used as the base metal. The step of annealing must be conducted as a preliminary step to said methods. If an annealing temperature is below 1,000° C., the grain size cannot reach 4 μm, and the coarseness of grain size is not satisfactory, whereas, if it is above 1,200° C., the coarseness of grain size is so high that the grain size unpreferably exceeds 10 μm.

Appropriate annealing time is, for example, about 30 minutes, if the annealing temperature is 1,100° C., but if the annealing temperature is high, the annealing time must be shortened, whereas, if the annealing temperature is low, the annealing time must be prolonged. Actually, it is desirable to experimentally determine annealing times at various annealing temperatures so that the base metal can have grain sizes of 4–10 μm.

The platinum film or rhenium film is usually formed by vacuum vapor deposition, but can be formed by any other means so far employed, for example, by plating, etc. Other matters on the metod are the same as described above as to the electron tube cathode.

In the present electron tube cathode, deterioration of emission characteristics is quite less, and peeling of the electron emitting material layer is satisfactorily prevented, even if the present electron tube cathode is put in service for a long period of time. Furthermore, since the platinum or rhenium film is 1,000–2,000 Å thick, oxidation of the base metal can be satisfactorily prevented when television tubes are produced, and formation of an interface layer of tungsten system can be suppressed. In the actual television performance, the platinum layer or the rhenium layer is diffused into the base metal, and consumed, and consequently never serves as a bar against the diffusion of the reducing impurity, and thus a satisfactory emission can be expected together with said effects.

Furthermore, since a Ni-based alloy containing tungsten in solid solution approximately up to its solubility limit is used in the present electron tube cathode, the temperature strength and the electric resistance are high, and the rise time for reaching an actuation state can be shortened to provide a directly heated type cathode by making the base metal sufficiently thin.

DESCRIPTION OF THE PREFERRED EMBODIMENTS OF THE INVENTION

EXAMPLE 1

In a process for producing television tubes in a mass production scale, there are three steps in which oxidation of a base metal is inevitable. These are a step of fixing an electron gun to a television tube by means of a gas burner, a step of outgassing the electron gun, and a step of decomposition of alkaline earth metal carbonate. In the first step, the cathode is heated at 400°–450° C. in the atmosphere for about 5 minutes, whereas in the latter two steps the cathode is heated at 700° C. in a vacuum of $10^{-2}$–$10^{-3}$ Torr for about 3 minutes. Once the surface of base metal of Ni-W alloy has been oxidized, a large amount of an interface layer of tungsten system is formed. The presence of the interface layer of tungsten system promotes formation of an interface layer of a compound of reducing impurity, for example, zirconium system. Thus, an emission of the cathode is lowered, and at the same time peeling of the electron emitting material layer is very liable to take place. That is, it is necessary to coat the surface of base metal with a material capable of withstanding oxidation and giving no adverse effect upon the emission characteristics.

It is possible to simulate a formation process of said interface layer according to a model test by heating in an electric furnace. Thus, test pieces were prepared in the following manner:

A Ni-28.0 wt.% W-0.4 wt.% Zr alloy was used as a base metal, and three kinds of cathode metal were prepared by (i) cutting the alloy as such to cathode metal pieces, 1 cm×1 cm, (ii) providing a nickel film, 1,500 A thick, on the surface of the alloy and then cutting the resulting alloy to cathode metal pieces, 1 cm×1 cm, and (iii) providing a platinum film, 1,500 A thick, on the surface of the alloy, and then cutting the resulting alloy to cathode metal pieces, 1 cm×1 cm. The platinum film and the nickel film were formed by vacuum vapor deposition.

Test pieces were then prepared according to the following three kinds of processes, and their properties were individually investigated.

(i) The base metal without the film, annealed at 900° C. for 30 minutes in advance, was coated with an alkaline earth metal carbonate. $(Ba_{0.5}Sr_{0.4}Ca_{0.1})CO_3$ by a spraying method, kept at 1,000° C. in vacuum for 0.5–10 hours, and then cooled to room temperature, and the formed alkaline earth metal oxide was removed by ethanolum absolutum, and an interface layer on the surface of base metal was investigated by X ray diffraction (CuKα beam, filter: Ni, voltage: 40 KV, current: 30 mA). The case of $2\theta=29.5°$ was deemed to be $Ba_3WO_6$ diffraction beam, and the case of $2\theta=30.2°$ $BaZrO_3$ diffraction beam.

Figure 1:
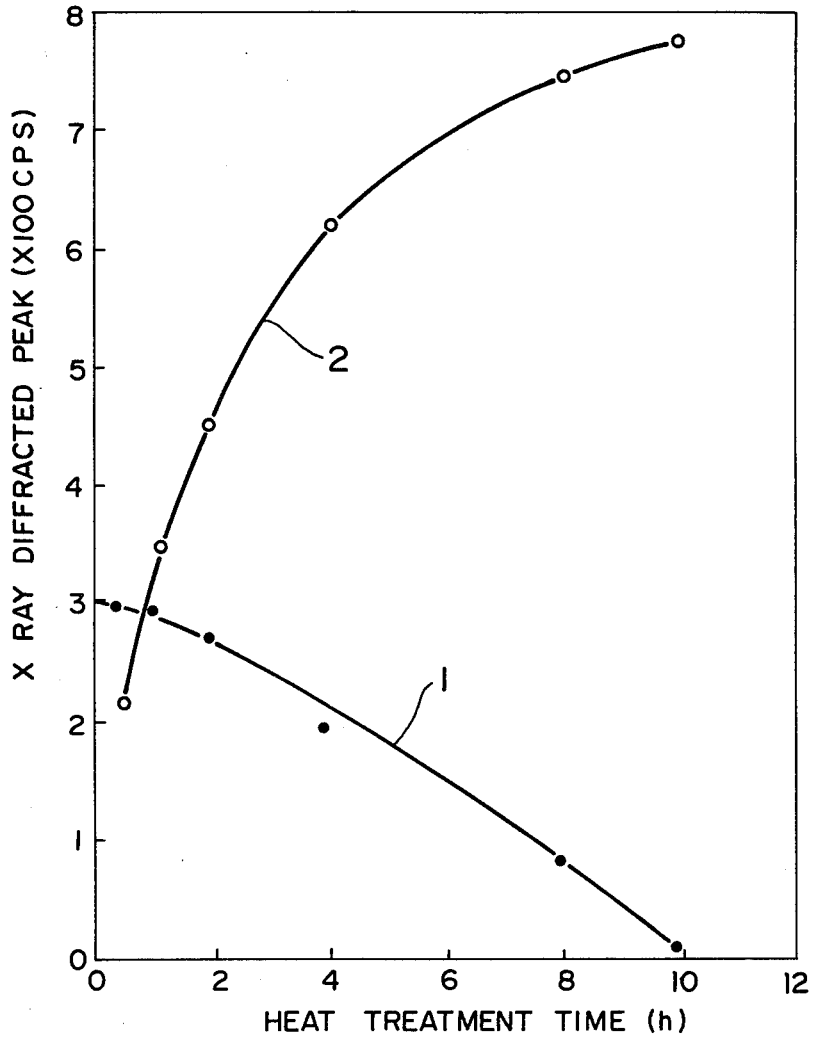
FIG. 1 is a graph showing relations between heat treatment time and amount of an interface layer formed.

Relations between the heat treatment time at 1,000° C. and the amount of the interface layer formed are shown in FIG. 1, where curve 1 is the case that the interface layer is $Ba_3WO_6$ and curve 2 is the case that the interface layer is $BaZrO_3$, and the amount of the interface layer formed is represented by a diffracted X ray peak.

It is evident from FIG. 1 that $Ba_3WO_6$ is formed in a considerable amount at the initial stage of reaction by heat treatment, and is decreased with reaction time. On the other hand, $BaZrO_3$ grows along grains with reaction time. Thus, the interface layer changes according to the following chemical reaction:

$$Ba_3WO_6+Zr\rightarrow BaZrO_3+W+Ba\uparrow \quad (1)$$

and behaves as a typical double activator.

$Ba_3WO_6$ relates to the oxidation of base metal, and the amount of $Ba_3WO_6$ formed is increased, as the base metal is increasingly oxidized. In fact, in the process for producing television tubes, there are steps in which the base metal is oxidized, for example, a step of sealing an electron gun into a television tube, a step of outgassing, a step of decomposition and gas exhausting to change the alkaline earth metal carbonate to an oxide, etc. In such steps, $Ba_3WO_6$ is naturally formed on the base metal. $Ba_3WO_6$ formed at the initial stage of reaction is a portion failing to contribute to the emission, and reacts with a reducing impurity in the base metal and changes to another interface layer, for example, $BaZrO_3$.

Through the changes at the boundary between the base metal and the alkaline earth metal oxide layer, as described above, the decrease in emission or peeling of said oxide layer will take place. Thus, when a base metal consisting of an alloy containing tungsten in solid solution approximately up to its solubility limit is used, it is necessary to suppress the formation of $Ba_3WO_6$, first of all, to solve said difficulty. To this end, the surface of the base metal must be coated with an oxidation-resistant material layer.

(ii) Said three kinds of cathode metals were oxidized by heating at various temperatures not higher than 800° C. in the atmosphere for 10 minutes, and the oxidized surfaces were coated with said alkaline earth metal carbonate by a spray method, and heated at 1,000° C. in vacuum for 30 minutes to form alkaline earth metal oxide. Interface layers on the test pieces thus prepared were investigated by X-ray diffraction in the same manner as above.

Figure 2:
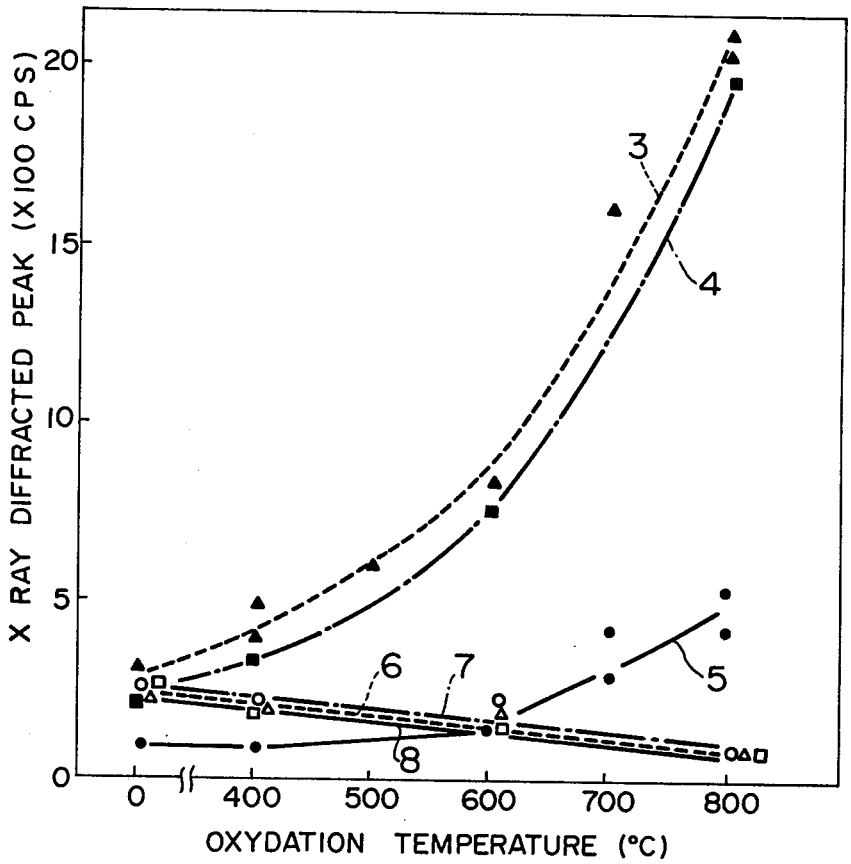
FIG. 2 is a graph showing relations between oxidation temperature and amount of an interface layer formed.

Relations between the oxidation temperature and the amount of the interface layer formed are shown in FIG. 2, where curves 3, 4 and 5 show the case of $Ba_3WO_6$, and curves 6, 7 and 8 show the case of $BaZrO_3$. Furthermore, curves 3 and 6 show the case of cathode metal without any film, curves 4 and 7 the case of cathode metal with the Ni film, and curves 5 and 8 the case of cathode metal with the Pt film. The amount of interface layer formed is represented by a diffracted X-ray peak.

As is evident from FIG. 2, it is difficult to suppress the formation of $Ba_3WO_6$ by means of the Ni film, but it is possible to suppress the formation of $Ba_3WO_6$ by means of the Pt film having a good oxidation resistance. However, even in the case of the Pt film, the effect of suppressing the formation of $Ba_3WO_6$ is gradually lost when the oxidation temperature becomes as high as 700°–800° C., because the Pt film starts to be alloyed into the base metal Ni-W alloy as a solid solution. Thus, it can be said that the Pt film ends its role by fulfilling the oxidation prevention at the initial stage of reaction and has been alloyed into the base metal as a solid solution when the electron tube is actuated.

Figure 3A:
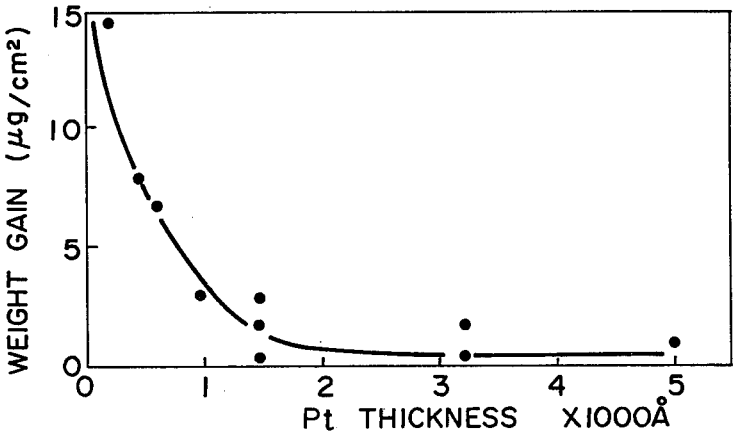
FIGS. 3A and 3B are graphs showing relations between thickness of platinum film provided on base metal and weight gain by oxidation.
Figure 3B:
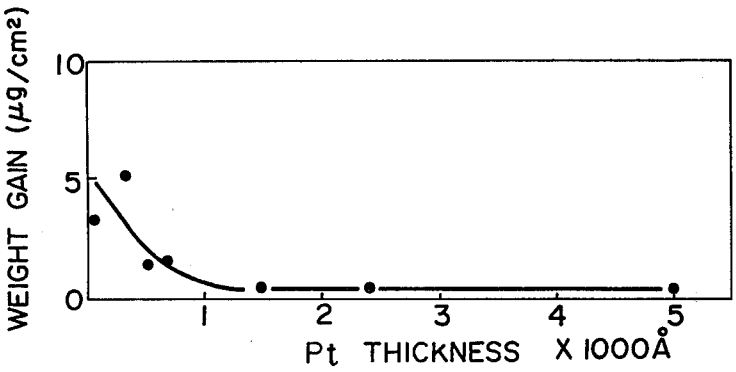

(iii) The cathode metal with the Pt film was oxidized by heating at 600° C. or 420° C. in the atmosphere for 10 minutes, and weight gains of the cathode metal were measured. Results are given in FIGS. 3A and 3B. FIG. 3A corresponds to the case that the oxidation temperature was 600° C., and FIG. 3B corresponds to the case of 420° C. As is evident from FIGS. 3A and 3B, the weight gain by oxidation is much less if the thickness of the Pt film is 1,000 Å or more, and thus the thickness of the Pt film must be 1,000 Å or more.

(iv) The electron tube cathode using a Ni-based alloy containing 20–28% by weight of tungsten as a base metal can be employed as a directly heated type, as already described above, but in that case the thickness of the base metal is made smaller, and thus the content of a reducing impurity such as zirconium must be increased. Consequently, an interface layer as compounds of Zr, etc. is disadvantageously formed in a large amount for a short period of time. In the present cathode, formation of an interface layer of tungsten system by oxidation is suppressed by providing a platinum film or a rhenium film on the base plate, and thus the interface layer consisting of compounds of Zr, etc. can be less formed with a considerably good effect. In order to obtain a better effect, the grain size of the base metal must be increased. That is, in order to suppress the diffusion of readily boundary-diffusible elements as Zr, the grain size must be increased by annealing the base metal at a high temperature, thereby reducing the diffusion paths for such elements. If the diffusion of Zr, etc. can be suppressed, the amount of Zr, etc. transferred to the surface of base metal is reduced, and consequently the formation of the interface layer is considerably reduced.

A Ni-28 wt.% W-0.4 wt.% Zr alloy plate annealed at various temperatures in a vacuum of $2\times10^{-6}$ Torr for 30 minutes was used as a base metal. A 1,500 Å thick Pt film was coated on the surface of the base metal, and then the resulting surface was coated with an alkaline earth metal carbonate, $(Ba_{0.5}Sr_{0.4}Ca_{0.1})CO_3$, by a spray method, and subjected to heat treatment at 1,000° C. in vacuum for 30 minutes. An interface layer on the base metal thus treated was investigated by X-ray diffraction in the same manner as above, and the grain size of the base metal after the annealing was measured by microscopic observation.

Figure 4:
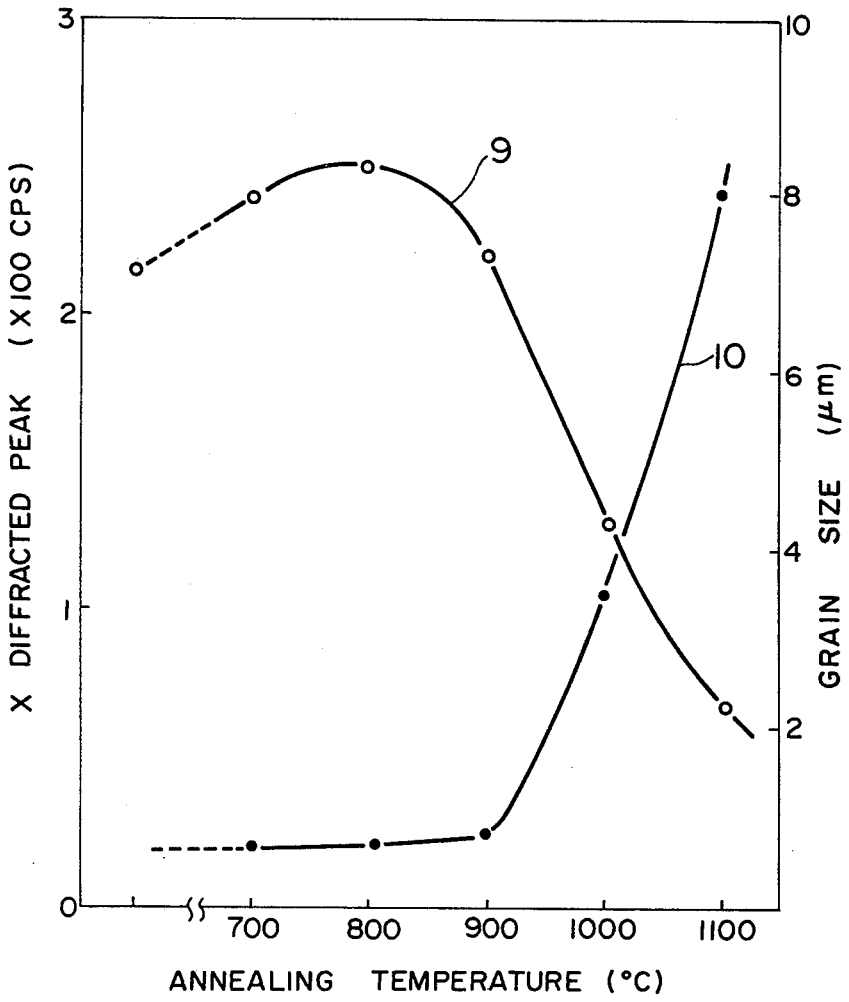
FIG. 4 is a graph showing relations between annealing temperature of base metal and grain size as well as amount of an interface layer formed.

Relations between the annealing temperature and the amount of the interface layer $BaZrO_3$ formed as well as the grain size are graphically shown in FIG. 4, where curve 9 shows the amount of $BaZrO_3$ formed, and curve 10 the grain size. The amount of the interface layer formed is represented by a diffracted X-ray peak.

As is evident from FIG. 4, the grain size is rapidly made larger and the amount of $BaZrO_3$ formed is correspondingly decreased by annealing the Ni-based alloy containing 28% by weight of tungsten at a temperature of 1,000° C. or higher. Thus, an annealing directed merely to removal of the working strain can be carried out effectively at 900° C., but in order to suppress the emission decrease of the cathode or the peeling of the alkaline earth metal oxide layer, it is desirable that the annealing temperature is 1,000° C. or higher, so that the grains can be made more coarse. As is also evident from FIG. 4, it is desirable that the grain size of the base metal is more than 4 μm to sufficiently decrease the amount of $BaZrO_3$ formed.

(v) Test pieces of said Ni-W-Zr alloy plate annealed at 900° C. for 30 minutes, test pieces of said Ni-W-Zr alloy plate annealed at 900° C. for 30 minutes and deposited with a 1,500 Å-thick Pt film, and test pieces of Ni-W-Zr alloy plate annealed at 1,100° C. for 30 minutes and deposited with a 1,500 Å-thick Pt film were prepared, and the surfaces of cathode metals of these test pieces were coated with alkaline earth metal carbonate $(Ba_{0.5}Sr_{0.4}Ca_{0.1})CO_3$ by a spray method, and subjected to heat treatment at 1,000° C. in vacuum for 0.5–10 hours. Interface layers on the base metals were investigated by X-ray diffraction in the same manner as above.

Figure 5:
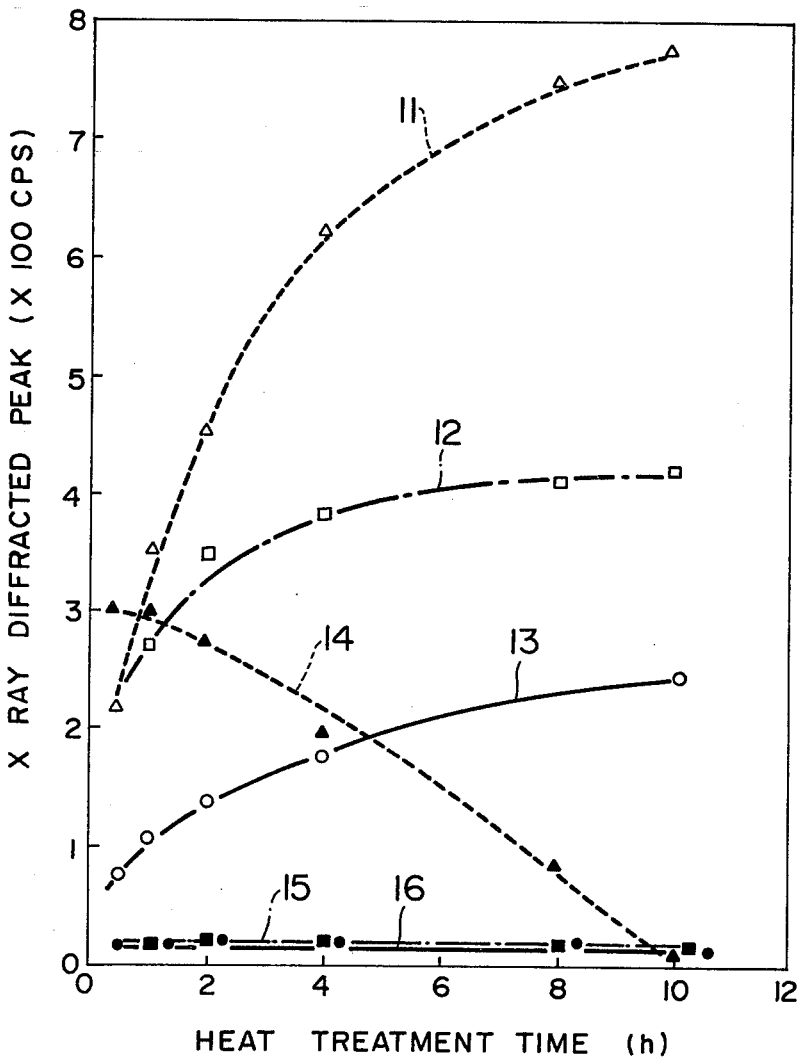
FIG. 5 is a graph showing relations between heat treatment time and amount of an interface layer formed for the respective base metal annealing temperatures.

Relations between the heat treatment time and the amount of the interface layer formed are shown in FIG. 5, where curves 11, 12 and 13 show the case of $BaZrO_3$, and curves 14, 15 and 16 the case of $Ba_3WO_6$. Further, curves 11 and 14 show the case of base metal without the film and the annealing temperature of 900° C., curves 12 and 15 the case with the Pt film and the annealing temperature of 900° C., and curves 13 and 16 the case with the Pt film and the annealing temperature of 1,100° C. The amount of the interface layer formed is represented by diffracted X-ray peak.

As is evident from FIG. 5, no $Ba_3WO_6$ was formed and also the formation of $BaZrO_3$ was suppressed when the cathode metal annealed at 1,100° C. for 30 minutes and then deposited with the Pt film was used. When the cathode metal annealed at 900° C. for 30 minutes and then deposited with the Pt film was used, $BaZrO_3$ was less formed, since $Ba_3WO_6$ was formed in a small amount at the initial stage of reaction, and consequently, the successive substitution reaction did not take place.

In the present example, the atmosphere for the heat treatment after the coating of the alkaline earth metal carbonate was a vacuum established by a diffusion pump, and the vacuum was $10^{-4}$ Torr at the initial stage of the heat treatment, and thereafter $10^{-6}$ Torr. The reason why the vacuum is somewhat low at the initial stage of the heat treatment is that at the initial stage the alkaline earth metal carbonate is converted to its oxide, generating a carbon dioxide gas.

Example 2

This example relates to a cathode having nickel powders on the surface of base mtal.

Figure 6A:
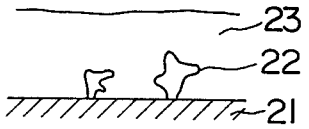
FIGS. 6A to 6F are cross-sectional views of cathodes with nickel powders for preventing an electron emitting material layer from peeling.
Figure 6B:
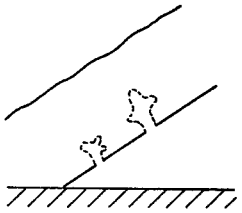
Figure 6C:
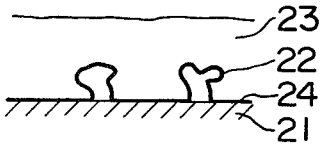
Figure 6D:
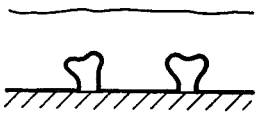
Figure 6E:
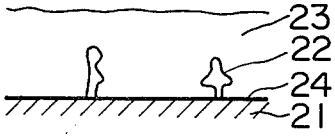

A ternary alloy of Ni-27.5 wt.% W-0.4 wt.% Zr was used as a base metal, and the surface of the alloy was deposited with nickel carbonyl powders of chain structure by a spray method, so that a deposition weight per surface area could be about 1.5 mg/cm$^2$, and then subjected to a vacuum sintering treatment at 900° C. for 30 minutes. As the carbonyl nickel powders, Inco #287 (trademark of a product made by Inco, U.S.A.) was used. The heat treatment after the deposition of carbonate was carried out at 900° C. for 500 hours in a vacuum of $10^{-8}$ Torr established by ion pump exhausting. However, contrary to the expectation, peeling of the oxide layer took place when the vacuum was broken after the test, and the cathode was taken into the atmosphere. This shows that a potential for the peeling was already high even in the vacuum. On the other hand, it was found that, even if the same nickel powders are used no peeling substantially take place by providing a platinum film before the deposition of nickel powders or after the vacuum sintering treatment. The results are shown in FIGS. 6A to 6F, where 21 is a base metal, 22 nickel powders, 23 an oxide layer, and 24 a platinum film. FIGS. 6A and 6B show the cases without the platinum film, FIGS. 6C and 6D the cases of providing a 1,000 Å-thick platinum film after the nickel powders have been deposited on the base metal by the sintering, and FIGS. 6E and 6F the cases with the nickel powders deposited on a 1,000 Å-thick platinum film by the sintering after the platinum film has been provided on the base metal. Furthermore, FIGS. 6A, 6C and 6E show cross-sectional structures of cathodes before the heat treatment, and FIGS. 6B, 6D and 6F those after the heat treatment.

Figure 6F:
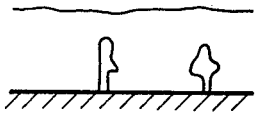

In the case without the platinum film, peeling of the oxide layer 23 takes place after the heat treatment, as shown in FIG. 6B. It was observed by a scanning electron microscope that the shapes of nickel powders for the peeling prevention were quite different, after the heat treatment, from those at the initial stage, and voids were formed inside the nickel powders. On the other hand, in the case with the platinum film, as shown in FIGS. 6C and 6E, no peeling of the oxide layer 23 took place even after the heat treatment, and the original shapes of the nickel powders could be maintained, as shown in FIGS. 6D and 6F. Particularly, in the case of providing the platinum film after the nickel powders have been deposited by the sintering, the structurally best state could be obtained. Though this mechanism has not been clarified yet, it seems that said phenomenon is occasioned by an eutectic reaction of oxides themselves resulting from the oxidation of the nickel powders or the oxidation of the base metal. The oxidation action takes place most vigorously during the process for producing television tubes, as mentioned in Example 1, and thus it can be said that the coating of the base metal or nickel powders with the platinum can prevent the structural change of the nickel powders.

Similar test was conducted also on Ni-W powders. In that case, no voids were formed inside in contrast to the nickel powders, but an interface layer of tungsten system was formed also on the surface of the powders, and the peeling was made very liable to take place. Also in that case, it was found that, if a platinum film is deposited by vapor deposition after the Ni-W powders have been vacuum sintered, the interface layer of tungsten system is less formed, and the peeling can be prevented.

Example 3

This example relates to an emission life of the present electron tube cathode.

Figure 7A:
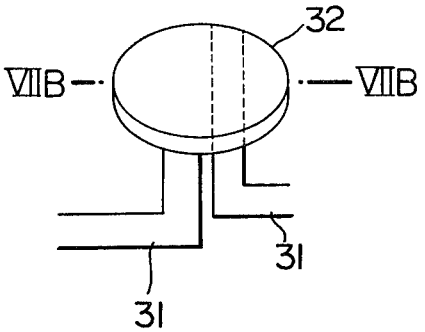
FIG. 7A is a sketch map of electron tube cathode according to one embodiment of the present invention.
Figure 7B:
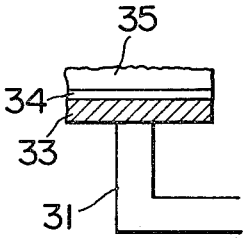
FIG. 7B is a cross-sectional view of FIG. 7A along the line VIIB—VIIB.
Figure 8:
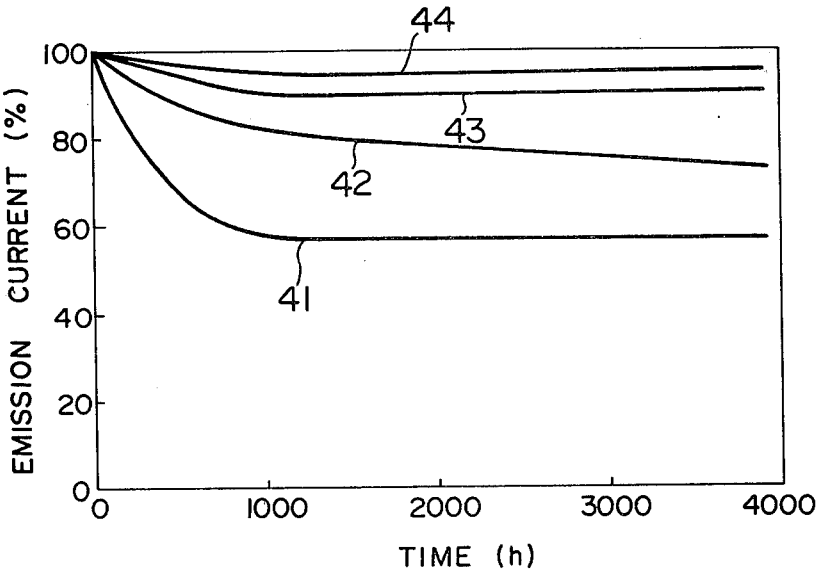
FIG. 8 is a graph showing relations between service time of various electron tube cathodes and emission current.

The alkaline earth metal carbonate was deposited on the surfaces of various cathode metals by a spray method. A sketch map of the electron tube cathode thus prepared is shown in FIG. 7A, and its cross-sectional view in FIG. 7B, where 31 are current leads, 32 cathode top face, 33 a base metal, 34 a platinum film, and 35 an alkaline earth metal oxide layer. The electron tube cathode is incorporated into a television tube and changes in emission with time were investigated. Results are shown in FIG. 8, where curve 41 is the case of Ni-27.5 wt% W-0.4 wt% Zr alloy as a base metal without any platinum film, curve 42 the case of Ni-0.05 wt% Mg alloy as a base metal without any platinum film, curves 43 and 44 cases of Ni-27.5 wt% W-0.4 wt% Zr as a base metal with a 1,000 Å-thick platinum film. In the cases of curves 41, 42 and 43, annealing was conducted at 900° C. for 30 minutes, and the resulting grain size was about 1 μm. On the other hand, in the case of curve 44, annealing was conducted at 1,100° C. for 30 minutes, and the resulting grain size was about 8 μm. In the cases of the cathode metal with the platinum film, the base metal was annealed before the deposition of the platinum film. Emission current was measured by setting the brightness temperature of the alkaline earth metal oxide to 730° C., and its initial value was presumed to be 100%. Curves 41 and 42 are reference examples for comparison.

As is evident from FIG. 8, the present electron tube cathodes based on the base metal with the platinum film (curves 43 and 44) had a considerably improved emission characteristic, as compared with the electron tube cathodes based on the conventional cathode metals of Ni-Mg alloy or Ni-W alloy without any platinum film or rhenium film (curves 41 and 42). Furthermore, the electron tube cathode having the cathode metal with the platinum film deposited on the base metal of Ni-W-Zr alloy of coarse grains (curve 44) had a particularly distinguished emission characteristic, and its emission lowering was much less even if the cathode was used for a prolonged time.

Furthermore, the electron tube cathode prepared by vacuum sintering the nickel powders onto the base metal of said Ni-W-Zr alloy, then providing the platinum film and further the alkaline earth metal oxide layer thereon had also a distinguished emission characteristic, and met a practical purpose satisfactorily without any peeling failure of the oxide layer.

All the foregoing examples illustrate the cases of providing the platinum film, but the present inventors made almost same studies on cases of providing a rhenium film as in the foregoing examples, and, as a result, found that almost same results as in the cases of providing the platinum film could be obtained.

What is claimed is:

1. An electron tube cathode comprising a base metal of Ni-based alloy containing tungsten in solid solution approximately up to its solubility limit and a very small amount of a reducing impurity, and an electron emitting material coating consisting of alkaline earth metal oxide on the base metal, characterized by a film of a material selected from the group consisting of platinum and rhenium being interposed between the base metal and the electron emitting material coating, said film having a thickness sufficient to prevent peeling of the electron emitting material coating, due to a tungsten interface layer being formed between the electron emitting material coating and said base metal, yet still permitting diffusion of the reducing impurity during operation of said tube cathode, said base metal having a grain size of 4–10 μm.

2. An electron tube cathode according to claim 1, characterized in that the base metal contains 20–28% by weight of the tungsten.

3. An electron tube cathode according to claim 2, characterized in that the base metal contains 25%–28% by weight of tungsten.

4. An electron tube cathode according to claim 1, characterized in that the film has a thickness of 1,000–2,000 Å.

5. An electron tube cathode according to claim 1 or 3, characterized in that the film consists of platinum.

6. An electron tube cathode according to claim 1, characterized in that the base metal contains 20–28% by weight of tungsten and the film consists of 1,000–2,000 Å-thick platinum.

7. An electron tube cathode according to claim 6, characterized in that the reducing impurity is at least one of zirconium and hafnium.

8. An electron tube cathode according to claim 1 or 4, characterized in that powders of nickel or nickel-tungsten alloy are further provided between the film and the electron emitting material coating.

9. An electron tube cathode according to claim 8, characterized in that said nickel-tungsten alloy further provided has substantially the same tungsten content as the tungsten content of said base metal.

10. An electron tube cathode according to claim 1 or 4, characterized in that powders of nickel or nickel-tungsten alloy are further provided between said base metal and the film.

11. An electron tube cathode according to claim 10, characterized in that said nickel-tungsten alloy further provided has substantially the same tungsten content as the tungsten content of said base metal.

* * * * *